US007654280B2

(12) United States Patent
Wu

(10) Patent No.: US 7,654,280 B2
(45) Date of Patent: Feb. 2, 2010

(54) ANTI-FREEZING HYDRANT

(75) Inventor: Faucet Wu, Shenang Township, Changhua County (TW)

(73) Assignee: Long Tai Copper Co., Ltd., Changua County (TW)

( * ) Notice: Subject to any disclaimer, the term of this patent is extended or adjusted under 35 U.S.C. 154(b) by 127 days.

(21) Appl. No.: 12/038,868

(22) Filed: Feb. 28, 2008

(65) Prior Publication Data

US 2009/0217984 A1 Sep. 3, 2009

(51) Int. Cl.
*E03B 9/02* (2006.01)
*E03B 9/14* (2006.01)

(52) U.S. Cl. ..... 137/301; 137/62; 137/60

(58) Field of Classification Search ..... 137/62, 137/60, 301, 302, 272, 360
See application file for complete search history.

(56) References Cited

U.S. PATENT DOCUMENTS 6,805,154 B1 * 10/2004 Dickey et al. ..... 137/360
6,857,442 B1 * 2/2005 Ball et al. ..... 137/301

* cited by examiner

*Primary Examiner*—Kevin L Lee
(74) *Attorney, Agent, or Firm*—Ming Chow; Sinorica, LLC

(57) ABSTRACT

An anti-freezing hydrant is provided with a hollow valve rod of which a back end is provided with a lump formed with an oblique cone where a water leakage hole is formed communicating with the valve rod. A one-way valve is provided in a inner water inlet in a valve chamber of a valve and comprises a rubber cushion being made of a soft rubber and thus elastically suppressing the inner water inlet. The bore of a back pressure stopper in a back pressure is a complement of an inner inclined cone with the oblique cone. Thus, the rubber cushion may enhance the capability of sealing of the valve. Further, the back pressure stopper may also be a good sealant for the inclined cone.

5 Claims, 7 Drawing Sheets

ANTI-FREEZING HYDRANT

BACKGROUND OF THE INVENTION

1. Field of the Invention

This invention relates to the structure of a hydrant and particularly to a anti-freezing hydrant.

2. Description of Related Art

Refer to FIG. 1 as an exploded view illustrating the appearance of a conventional anti-freezing hydrant. The anti-freezing hydrant 10 mainly comprises an outer tube 11; one end of the outer tube 11 is provided with a water inlet 111 and the other end is provided with a joint port 112 and a water outlet 113. A handle knob 12 and a valve 13 are assembled in the joint port 112. The handle knob 12 is assembled onto the joint port 112 and may revolve the valve 13 to valve the water inlet 111 or the water outlet 113. In order to follow the standard of ASSE-1019A, refer to FIG. 2. A back pressure valve 14 is provided in the valve 13 for water to flow from the water inlet 111 in a single way. Further, the handle knob 12 is provided with a hollow valve rod 121 of which an end is provided with a lump 122 on which a water leakage hole 123 is formed. Here, a back pressure device 15 is provided between the handle knob 12 and the valve 13 and comprises a back pressure stopper 151 and an elastic component 152. With the bounce effect applied by the elastic component 152, the back pressure stopper 151 stops the water leakage hole 123 of the lump 122, and a gum ring is adhered to a side of the stopper 151 to seal the hole 123. When water is led into the water outlet 113 due to siphonage, the back pressure stopper 151 draws back because of the pressure of water; the gum coil 153 cannot stop the water leakage hole 123 so that water may be led into the valve rod 121 from the water leakage hole 123 and thus leaks out of the handle knob 12, thereby a warning being given. For use, the gum ring 153 is adhered onto the back pressure stopper 151 but easily falls off and gets aging after being used, thereby failing and causing the water leakage hole 123 to give an erroneous warning. The water leakage hole 123 is designed in the manner of inclined plane machining and is not easily processed. Next, the back pressure valve 14 stops water by using an O-shaped ring 141. The O-shaped ring 141 is subject to and blocked with foreign matters and thus cannot fully block water, thereby providing poor effect of leakage blocking.

Consequently, because of the technical defects of described above, the applicant keeps on carving unflaggingly through wholehearted experience and research to develop the present invention, which can effectively improve the defects described above.

SUMMARY OF THE INVENTION

In this invention, an anti-freezing hydrant is provided comprising at least one outer tube of which one end is provided with a water inlet and the other end is provided with a joint port and a water outlet; a handle knob in which a handlebar is connected to the joint port and provided with a hollow valve rod of which an end is provided with a lump formed with an oblique cone where the water leakage hole communicates with the valve rod, in which an end of the lump is provided with a first joint; a valve inside which a hollow valve chamber is formed and provided with an inner water inlet communicating with the water inlet, and an inner water outlet provided with a switching valve provided with a second joint connected to the first joint that may control the switching valve, in which a one-way valve is provided between the inner water inlet and the switching valve and comprises a rubber cushion made of a soft rubber, a seat, and a elastic component, in which the seat is assembled with the rubber cushion and the elastic component so that the elastic component may apply an elastic force onto the rubber cushion, thereby the rubber cushion being made to elastically suppress the inner water inlet; a back pressure device comprising an elastic component and a back pressure stopper and being provided between the valve and the handle knob, in which a bore of the back pressure stopper is a complement of an inner inclined cone with the oblique cone, and a one-way back pressure gasket is provided around the outside of back pressure stopper, in which the mouth of one-way back pressure gasket is provided at a side of the water outlet and the elastic component is connected to the back pressure stopper and then applies an elastic force.

In the anti-freezing hydrant according to this invention, the rubber cushion of one-way valve may be well deformed and thus seals the inner water inlet; even if being blocked by the foreign matters, it may be a good sealant. Besides, the area of contact of the inner cone with the inclined cone of the back pressure stopper is larger, the accuracy of warning may also be relatively higher.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
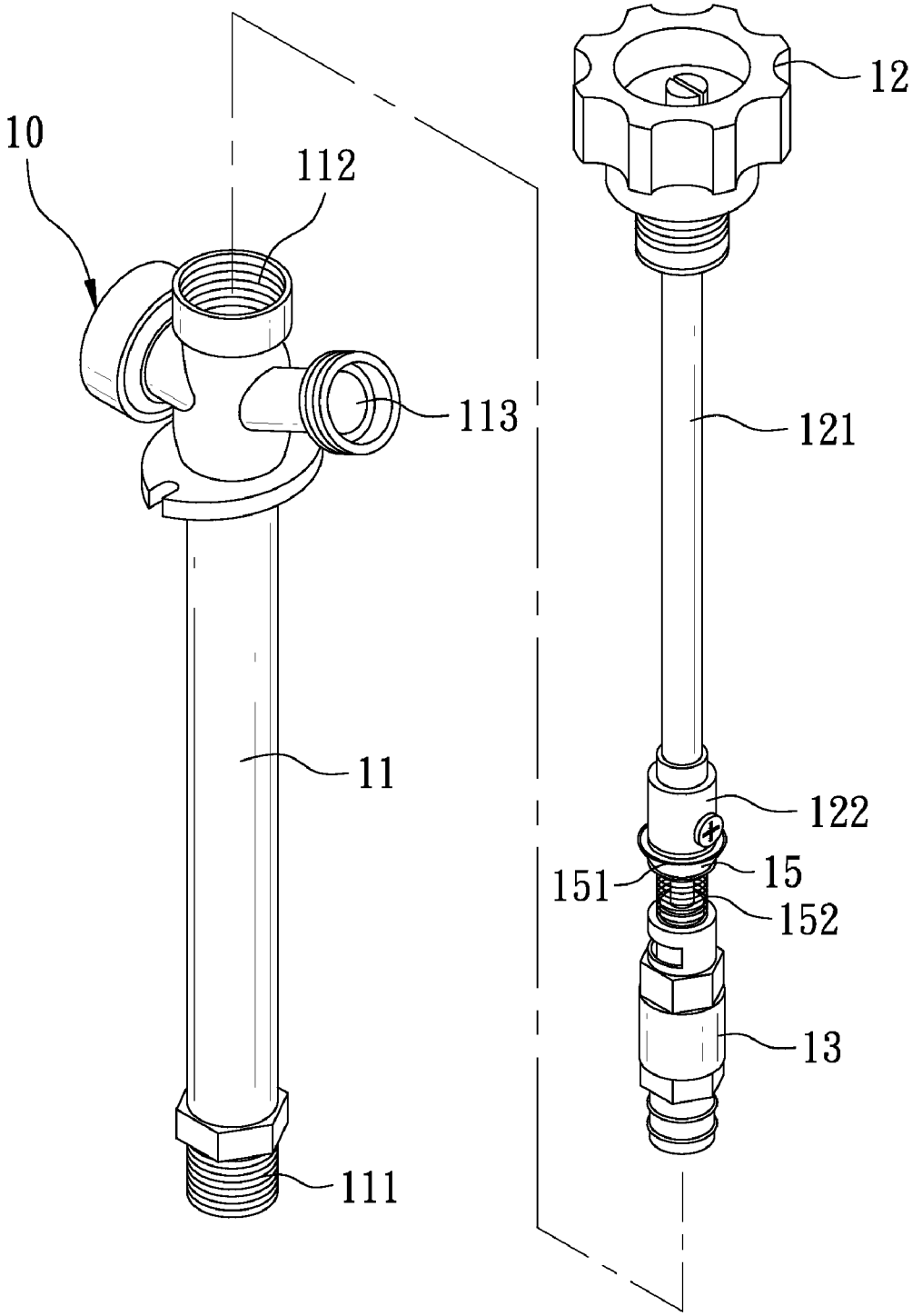
FIG. 1 PRIOR ART
FIG. 1 is a view of the appearance of a conventional anti-freezing hydrant.
Figure 2:
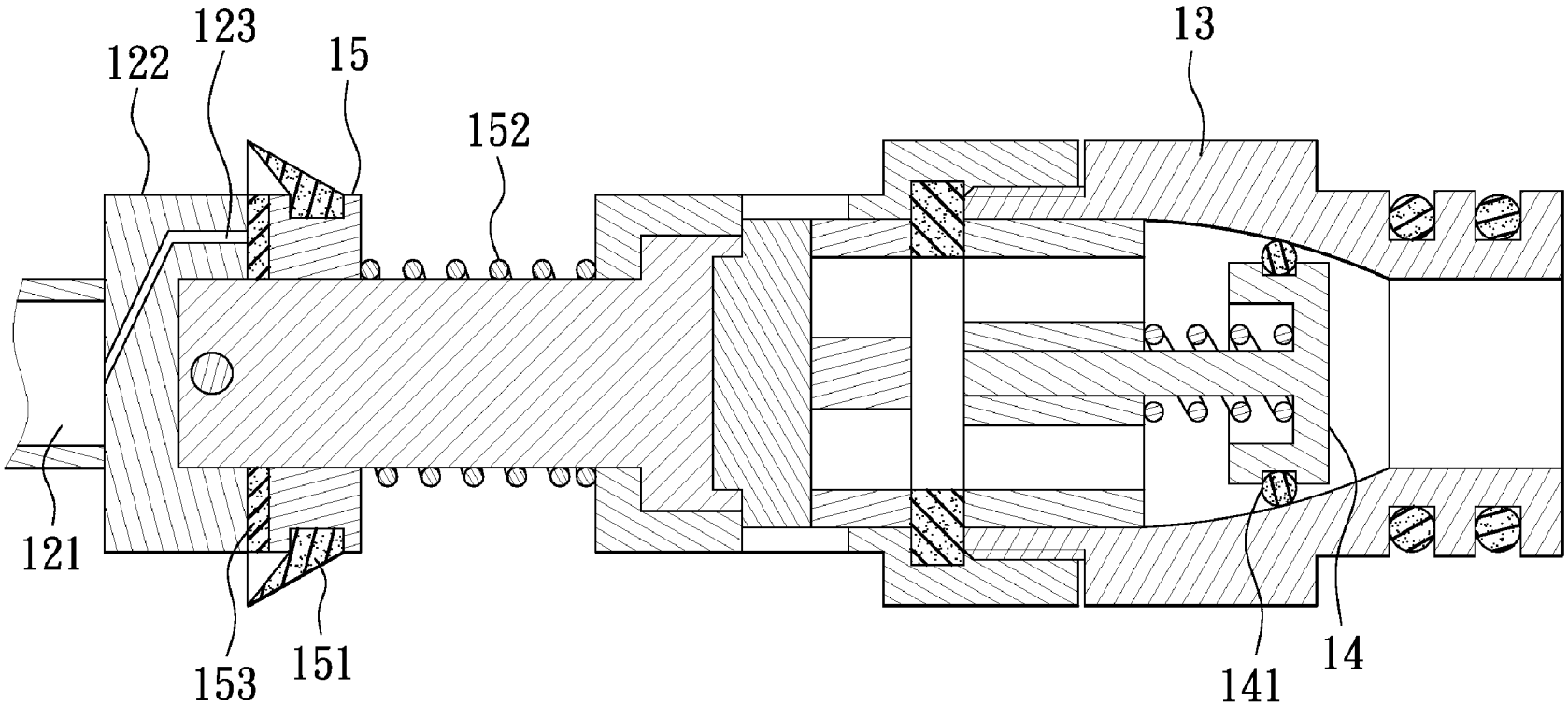
FIG. 2 PRIOR ART
FIG. 2 is a partially sectional view of the conventional anti-freezing hydrant.
Figure 3:
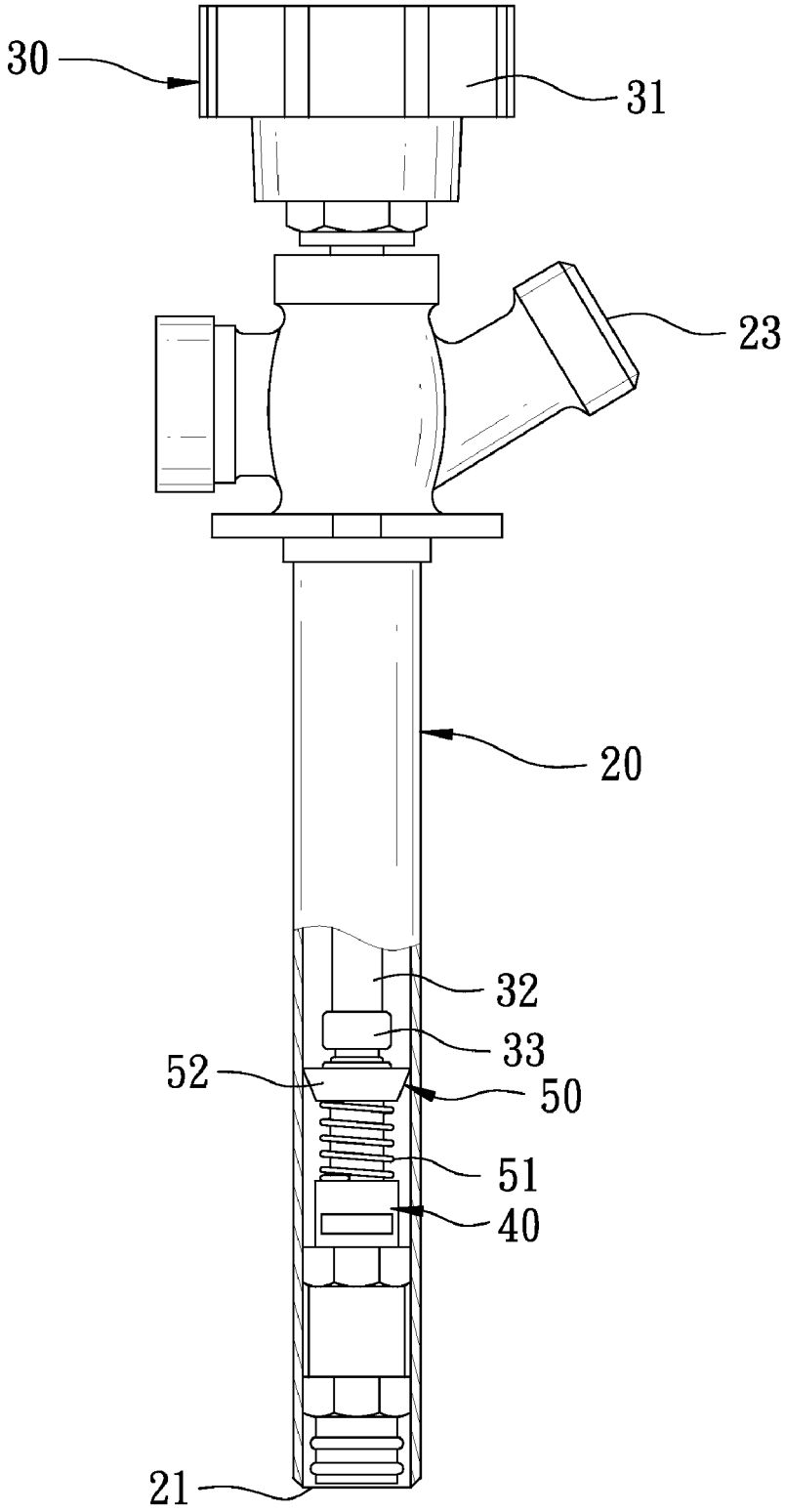
FIG. 3 is a plan view of the preferred embodiment of this invention.
Figure 4:
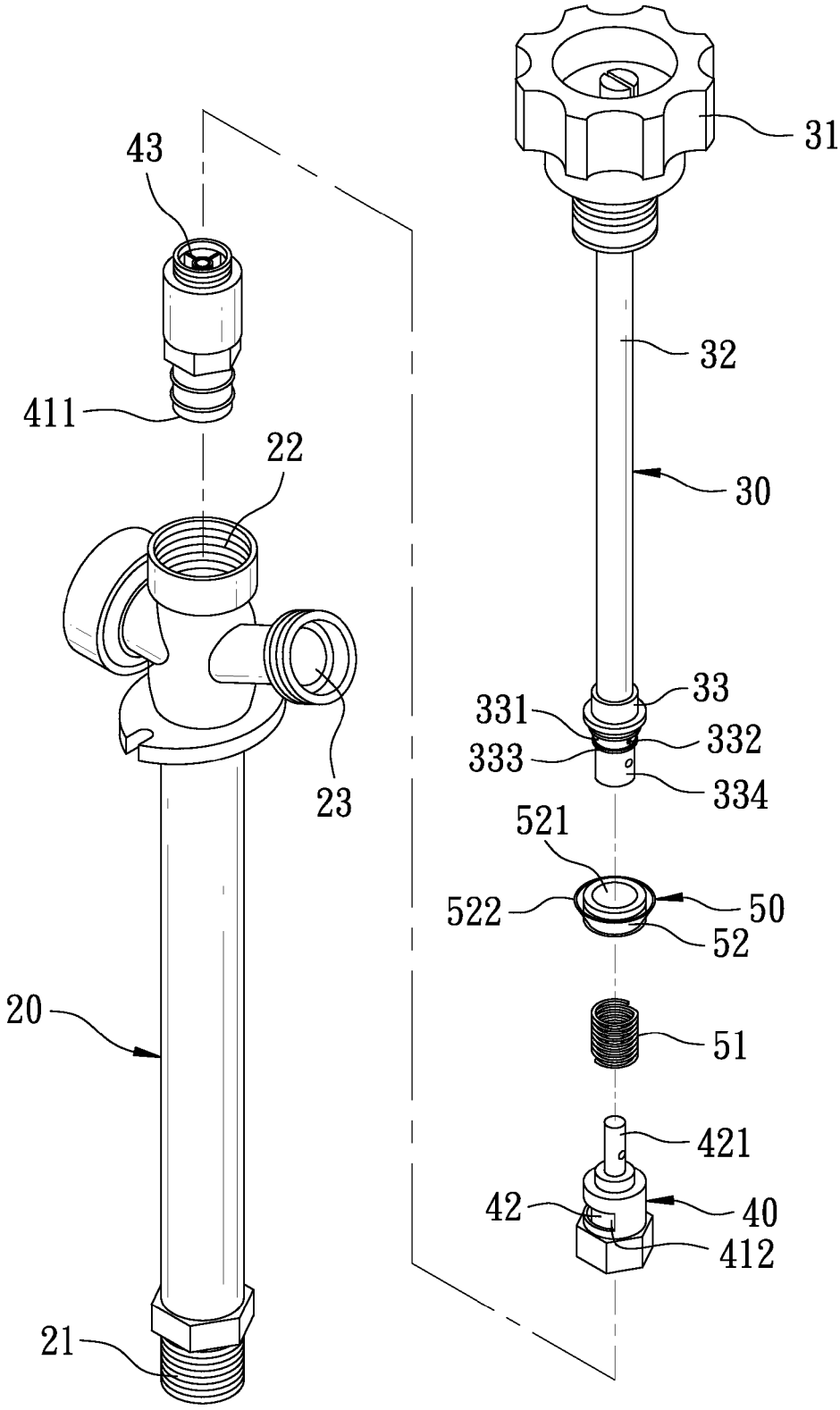
FIG. 4 is an exploded view of the preferred embodiment of this invention.
Figure 5:
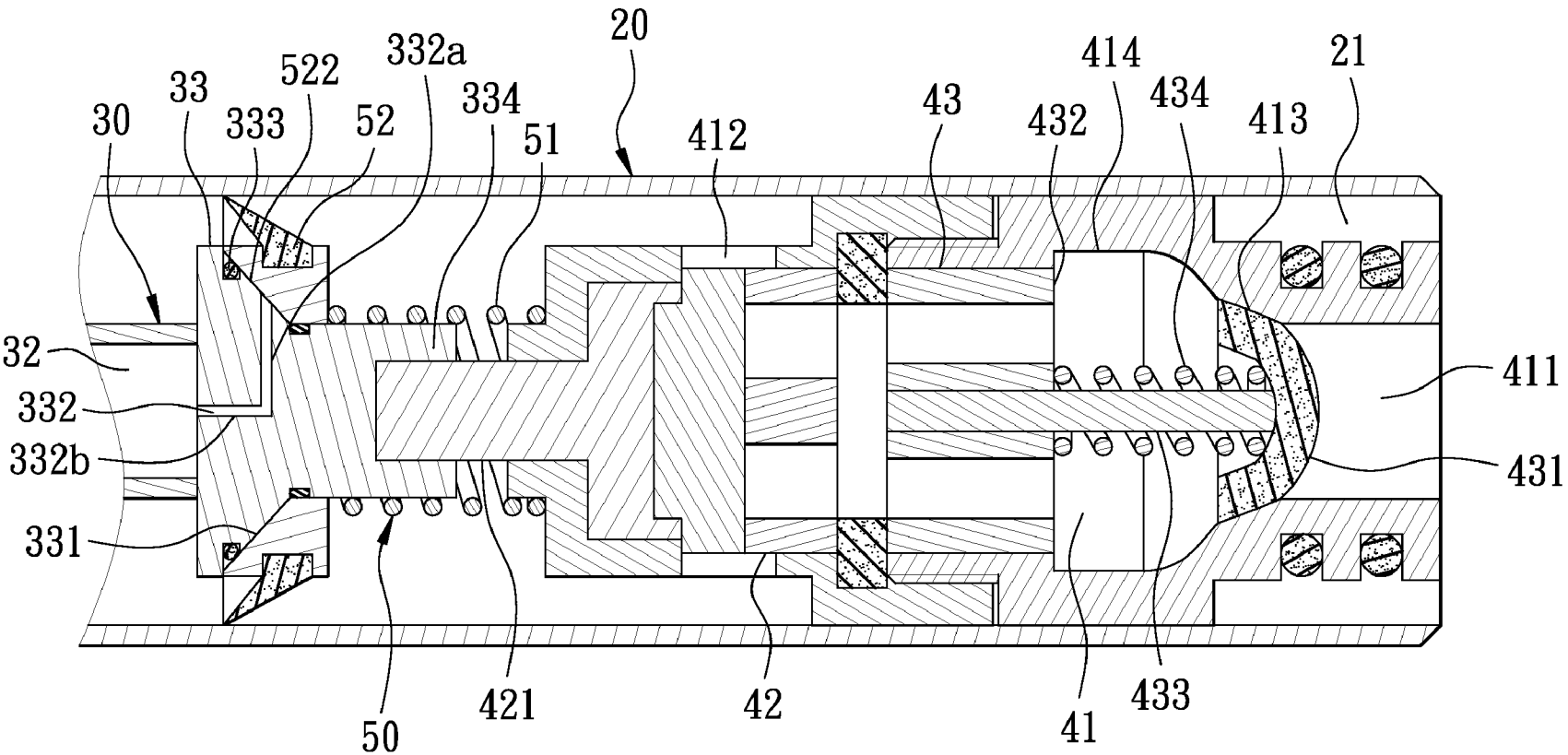
FIG. 5 is a partially sectional view of the preferred embodiment of this invention.

Firstly, with reference to FIGS. 3 through 5 respectively as a assembly semblance view, an exploded view, and a partially sectional view illustrating an anti-freezing hydrant in a preferred embodiment of this invention, the anti-freezing hydrant comprises an outer tube 20, a handle knob 30, a valve 40, and a back pressure device 50.

One end of the outer tube 20 is provided with a water inlet 21 and the other end is provided with a joint port 22 and a water outlet 23.

In the handle knob 30, a handlebar 31 is connected to the joint port 22. The handlebar 31 is provided with a hollow valve rod 32 of which an end is provided with a lump 33 formed with an oblique cone 331 where a water leakage hole 332 communicates with the valve rod 32. The water leakage hole 332 comprises a radial portion 332*a* that is formed in radial along a side of the surrounding of lump 33, and an axial portion 332*b* is axially provided along the lump 33 with respect to the end of valve rod 32 so as to exactly connect with the radial portion 332*a*, thereby the water leakage hole 332 being made to communicate with the valve rod 32. The inclined cone 331 is provided with a leakage blocking ring around each of two sides of the water leakage hole 332. A first joint 334 is provided at an end of the lump 33.

In the valve 40, a hollow valve chamber 41 is formed with an inner water inlet 411 communicating with the water outlet 21. An internally tangent plane of the inner water inlet 411 in the valve chamber 41 is a camber 413 from which a gradually expanded flow space 414 stretches, and an inner water outlet 412 provided with a switching valve 42 is formed at the other end. The switching valve 42 is provided with a second joint 421 connected to the first joint 334 and may be controlled by the handle knob 30 to switch ON or OFF the inner water outlet 412. Further, a one-way valve 43 is provided between the inner water inlet 411 and the switching valve 42 and comprises a rubber cushion 431 made of a soft rubber, a seat 432, a shift limit rod 433, and an elastic component 434. The seat 432 is pivoted with the shift limit rod 433 put around the elastic component 434. Next, an end of the shift limit rod 433 is put around the rubber cushion 431 so that the elastic component 434 may apply an elastic force onto the rubber cushion 431, thereby the rubber cushion 431 being made to elastically suppress the inner water inlet 411.

The back pressure device 50 comprises an elastic component 51 and a back pressure stopper 52 and is provided between the valve 40 and the handle knob 30. Around the bore of back pressure stopper 52, an inner cone 521 that is complementary with the inclined cone 331 is provided. A one-way back pressure gasket 522 is provided around the outside of back pressure stopper 52, in which the mouth of one-way back pressure gasket is toward a side of the water outlet 23. The elastic component 51 is connected to the back pressure stopper 52 and then applies an elastic force. Being affected with the effect of flexibility, the back pressure stopper 52 ordinarily seals the water leakage hole 332.

In order to further make apparent the structural features, applied skill and manners, and expected effects according to this invention, what are applied in this invention are in detail described, and it is thus believed that this invention is thoroughly and concretely apparent, as described below.

Figure 6:
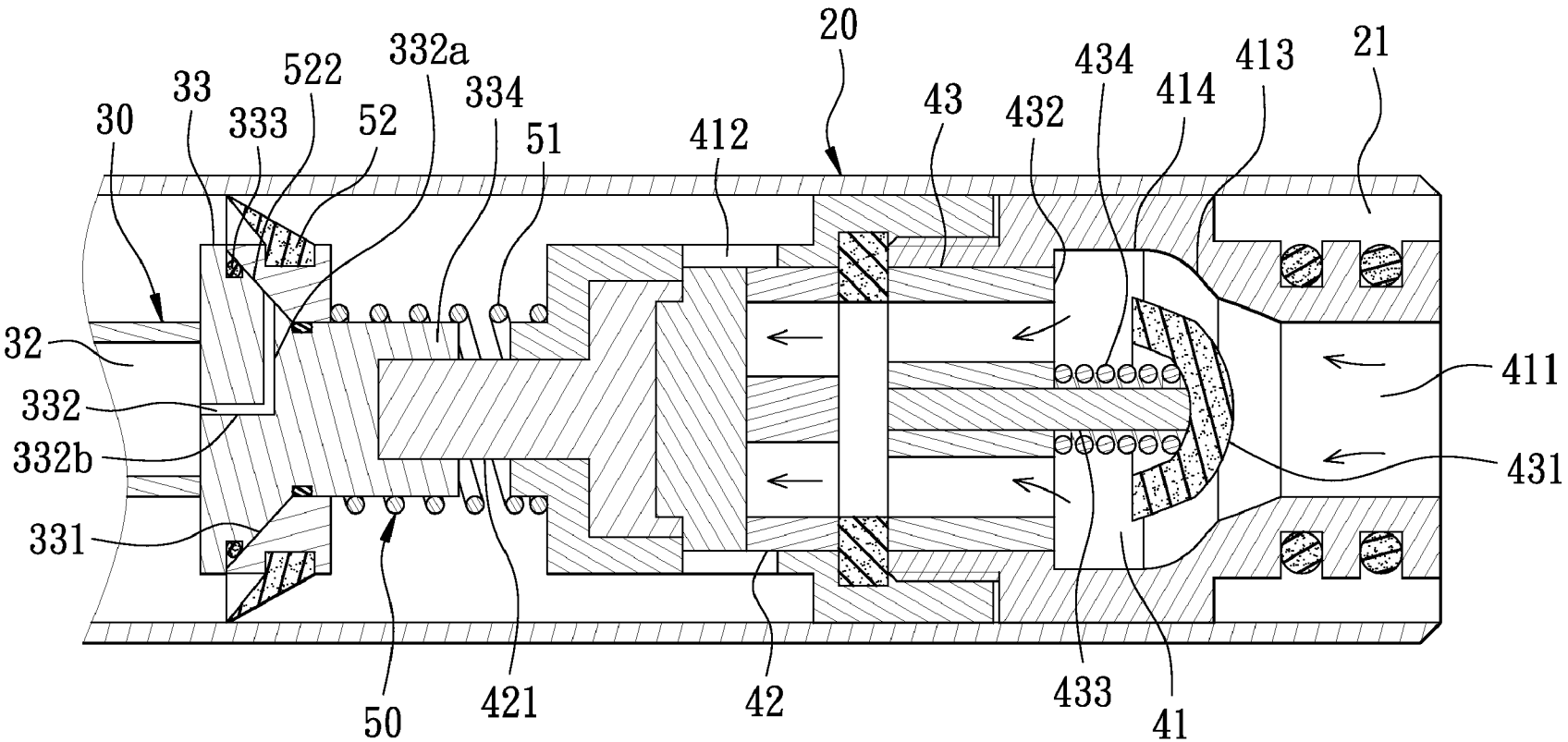
FIG. 6 is a sectional view of the operation of a one-way valve in the preferred embodiment of this invention.

Still with reference to FIGS. 3 through 5, generally, when flowing in, water is led into the inner water inlet 411 from the water inlet 21 and enters the valve chamber 41; the handle knob 30 is used to control the switching valve 42 for water flowing. With reference to FIG. 6 as a sectional view of a one-way valve according to this invention, water flows from the inner water inlet 411 into the valve chamber 41 and thus the water pressure impacts the rubber cushion 431; with the elastic component 434, the rubber cushion 431 moves toward the flow space 414 in the valve chamber 41 for water to flow into the valve chamber 41. When the handle knob 30 controls and shuts the switching valve 42, water does not flow into the water outlet 23; when the handle knob 30 controls and opens the switching valve 42, the valve chamber 41 communicates with the water outlet 23 and then water flow into the water outlet 23 to be fed. With the rubber cushion 431 made of the soft rubber, when there are foreign matters in the inner water inlet 411, the rubber cushion 431 is flexible to vary in shape with the foreign matters and thus block them from entering for enhancement of sealing effect and reliability.

Figure 7:
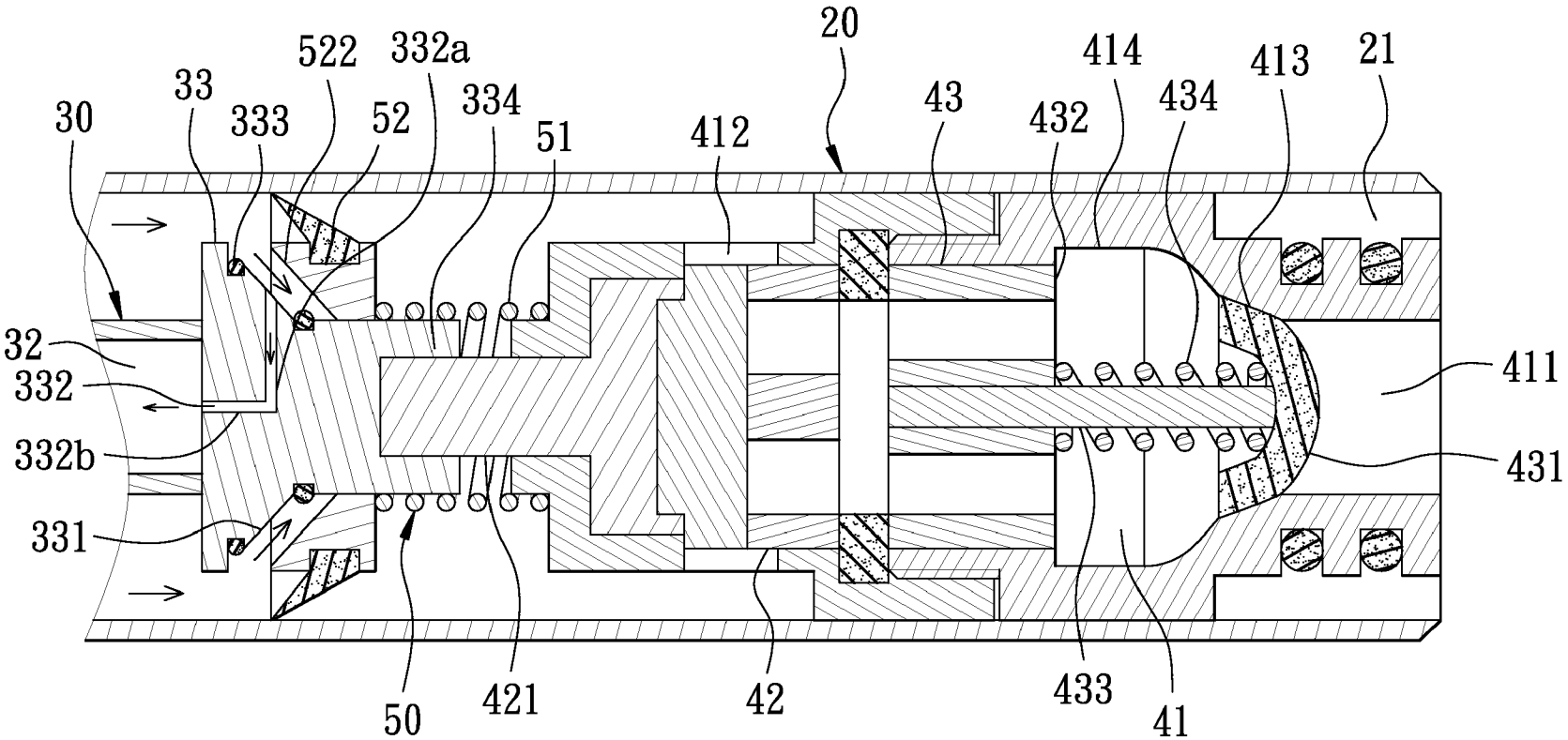
FIG. 7 is a sectional view of the operation of a back pressure device in the preferred embodiment of this invention.

With reference to FIG. 7 as a sectional view of the operation of a back pressure device according to this invention, when water being subject to the siphonage backwards flows from the water outlet 23, the one-way back pressure gasket 522 of back pressure stopper 52 is pushed by the water pressure and thus makes the inner cone 521 to be off the inclined cone 331. Here, water flows from the water leakage hole 332 into the valve rod 32 and then flows out of the handlebar 31, thereby a warning being given. Further, the water pressure pushes the rubber cushion 431 of one-way valve 43 to tightly suppress the inner water inlet 411 for achievement of the back pressure. Next, because being made of the soft rubber, the rubber cushion 431 may be a good sealant for the inner water inlet 411, so the rubber cushion 431 may well cover the inlet 411 even if there are foreign matters in the inner water inlet 411.

Thus, in this invention, complement of the inclined cone of lump with the back pressure stopper of back pressure device may enhance the effect of back pressure. Besides, the water leakage hole may be processed vertically and horizontally for convenience and precision.

Further, when there are foreign matters in the inner water inlet, the rubber cushion being made of the soft rubber in the one-way valve is flexible to vary in shape with the foreign matters for enhancement of sealing effect and reliability.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An anti-freezing hydrant, comprising:

an outer tube of which one end is provided with a water inlet and the other end is provided with a joint port and a water outlet;

a handle knob in which a handlebar is connected to the joint port and provided with a hollow valve rod of which a back end is provided with a lump formed with an oblique cone where a water leakage hole is formed communicating with the valve rod, in which an end of the lump is provided with a first joint;

a valve inside which a hollow valve chamber is formed and provided with an inner water inlet communicating with the water inlet, and with an inner water outlet provided with a switching valve provided with a second joint connected to the first joint that controls the switching valve, in which a one-way valve is provided between the inner water inlet and the switching valve and comprises a rubber cushion made of a soft rubber, a seat, and a elastic component, in which the seat is assembled with the rubber cushion and the elastic component so that the elastic component applies an elastic force onto the rubber cushion, thereby the rubber cushion being made to elastically suppress the inner water inlet; and a back pressure device comprising an elastic component and a back pressure stopper and being provided between the valve and the handle knob, in which a bore of the back pressure stopper is a complement of an inner inclined cone with the oblique cone, and a one-way back pressure gasket is provided around the outside of back pressure stopper, in which a mouth of the one-way back pressure gasket is provided toward a side of the water outlet and the elastic component is connected to the back pressure stopper and then applies an elastic force.

2. The anti-freezing hydrant according to claim 1, wherein the inclined cone is provided with a leakage blocking ring around each of two sides of the water leakage hole.

3. The anti-freezing hydrant according to claim 1, wherein the seat of the valve is pivoted with a shift limit rod, the elastic component is provided passing through the shift limit rod, and one end of the shift limit rod supports the rubber cushion.

4. The anti-freezing hydrant according to claim 1, wherein an internally tangent plane of the inner water inlet in the valve chamber is a camber provided for an outer annular plane of the rubber cushion to stay close to, and a gradually expanded flow space stretches from the camber in the valve chamber.

5. The anti-freezing hydrant according to claim 1, wherein the water leakage hole comprises a radial portion that is formed in radial along a side of the surrounding of the lump, and an axial portion is axially provided along the lump with respect to the end of valve rod so as to exactly connect with the radial portion, thereby the water leakage hole being made to communicate with the valve rod.

* * * * *